US011342147B2

(12) United States Patent
Benk et al.

(10) Patent No.: US 11,342,147 B2
(45) Date of Patent: May 24, 2022

(54) RELAY

(71) Applicant: Phoenix Contact GmbH & Co. KG, Blomberg (DE)

(72) Inventors: Stefan Benk, Bad Pyrmont (DE); Christian Adam, Hirzlei (DE); Ralf Hoffmann, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 17/274,629

(22) PCT Filed: Aug. 26, 2019

(86) PCT No.: PCT/EP2019/072689
§ 371 (c)(1),
(2) Date: Mar. 9, 2021

(87) PCT Pub. No.: WO2020/052945
PCT Pub. Date: Mar. 19, 2020

(65) Prior Publication Data

US 2022/0051862 A1 Feb. 17, 2022

(30) Foreign Application Priority Data

Sep. 12, 2018 (DE) ..... 10 2018 122 265.3

(51) Int. Cl.
*H01H 47/04* (2006.01)
*H01H 47/32* (2006.01)
*H01H 47/00* (2006.01)

(52) U.S. Cl.
CPC ..... *H01H 47/04* (2013.01); *H01H 47/32* (2013.01); *H01H 47/002* (2013.01)

(58) Field of Classification Search
CPC ..... H01H 47/002; H01H 47/04; H01H 47/32
(Continued)

(56) References Cited

U.S. PATENT DOCUMENTS 3,666,998 A 5/1972 Wielebski
4,862,866 A 9/1989 Calfus
(Continued)

FOREIGN PATENT DOCUMENTS

DE 21 16 714 A 10/1972
EP 2 071 425 A1 6/2009
(Continued)

OTHER PUBLICATIONS

Notice of Reasons for Refusal; Japanese Patent Application No. 2021-508287; Drafting date: Reiwa 4—Mar. 15, 2022; Patent Examiner: Kenichi Matsunaga (2925 3T00); Representative/Applicant: Patent Business Corporation YKI International Patent Office; Applied Provisions: Article 29 (2) (Inventive Step); Office Action Date: Mar. 22, 2022; 4 pgs.

*Primary Examiner* — Yemane Mehari
(74) *Attorney, Agent, or Firm* — Holland & Hart LLP

(57) ABSTRACT

The disclosure relates to an electromagnetic relay that comprises a yoke and an armature. The armature may be swivellably arranged on the yoke, have an open position and a contact position in relation to the yoke, and configured to be attracted by a magnetic field out of the open position into the contact position. The armature may include a first branch circuit having a first capacitor and a first exciter coil connected in series with the first capacitor, a second branch circuit having a second capacitor and a second exciter coil connected in series with the second capacitor, and a switch element arranged between the first branch circuit and the second branch circuit and having a first switch state and a second switch state. The first exciter coil and the second exciter coil may provide the magnetic field for attracting and retaining the armature.

20 Claims, 10 Drawing Sheets

(58) Field of Classification Search
USPC ..... 361/206
See application file for complete search history.

(56) References Cited

U.S. PATENT DOCUMENTS

| | | | | |
|---|---|---|---|---|
| 2018/0061600 | A1* | 3/2018 | Ito | H01H 9/443 |
| 2020/0126745 | A1* | 4/2020 | Wu | H01H 50/641 |
| 2021/0005414 | A1* | 1/2021 | Kuo | H01H 50/02 |

FOREIGN PATENT DOCUMENTS

| | | | |
|---|---|---|---|
| GB | 2480239 | A | 11/2011 |
| JP | 3163693 | U | 10/2010 |
| JP | 2016-157524 | A | 9/2016 |

* cited by examiner 401
701
100
602
401
607
606
605
604
101-1
102-1
701
601
603
603

701
701
607
602
606

603
605
604
601
603
101-1
102-1
100

RELAY

CROSS-REFERENCE TO RELATED APPLICATIONS

The present application is the national phase entry under 35 U.S.C. 371 of International Patent Application No. PCT/EP2019/072689 by Benk et al., entitled "RELAY," filed Aug. 26, 2019, and claims the benefit of German Patent Application No. 10 2018 122 265.3 by Benk et al., entitled "RELAIS," filed Sep. 12, 2018, each of which is assigned to the assignee hereof and is incorporated by reference in its entirety.

FIELD OF THE DISCLOSURE

The present disclosure relates to a relay, in particular an electromagnetic relay.

BACKGROUND

In the case of electromagnetic relays, there is the problem of heating due to the high coil currents used to attract the armature from an open position to a contact position, to close the relay. Since, however, a stronger magnetic field, and thus a greater magnetic flow, through the exciter coil is used for attraction than to hold the armature in the contact position, various measures are used to reduce the magnetic flow of the exciter coil after the armature has been attracted into the contact position and for the period in which the armature is retained in the contact position, reducing the output and consequently the heating of the relay for the period in which the relay is held closed. In some examples, pulse width modulation (PWM) is applied to the supply voltage to reduce the coil current to an advantageous value for the desired period of time. However, complex microelectronic components and correspondingly complex switch architectures are used for PWM control, and PWM control may be unsuitable for many applications.

SUMMARY

An improved relay, in particular an improved electromagnetic relay, is described herein.

The improved relay is achieved by the subject matter of independent claim 1. Advantageous implementations of these features are the subject matter of the dependent claims, the description, and the accompanying figures.

The improved relay enables the coil current to be reduced by increasing the total resistance of the exciter coil or the exciter coils while the supply voltage remains unchanged, thus reducing the relay output or the electrical output and thus the heat loss.

According to one aspect, the disclosure relates to an electromagnetic relay comprising a yoke and an armature which is swivellably arranged on the yoke and which has an open position and a contact position in relation to the yoke and which is configured to be attracted by a magnetic field out of the open position into the contact position to be retained in the contact position, a first branch circuit which has a first capacitor and a first exciter coil connected in series thereto, a second branch circuit which has a second capacitor and a second exciter coil connected in series with the same, the first exciter coil and the second exciter coil being configured to provide the magnetic field for attracting and retaining the armature, and a switch element which is arranged between the first branch circuit and the second branch circuit and having a first switch state and a second switch state, wherein the first branch circuit and the second branch circuit are arranged in a parallel connection in the first switch state of the switch element, and wherein the first exciter coil and the second exciter coil are arranged in a series connection in the second switch state of the switch element, and wherein the switch element is configured to switch from the first switch state to the second switch state if the armature is attracted into the contact position by the magnetic field of the first and second coils.

This has the technical advantage that a relay is provided whose coil power of the first and second exciter coils is automatically reduced from an attraction power that has to be provided to attract the armature from the open position into the contact position to a lower retaining power that may be applied to retain the armature in the contact position, as soon as the armature is fully attracted into the contact position. The contact position of the armature is the position of the armature in which contact is made between armature and yoke and the relay is closed, i.e. the relay has been pulled through completely.

The present relay with two interconnected exciter coils enables the total resistance $R_{ges}$ of the first and second exciter coils to be changed with individual resistances $R_1$ and $R_2$ by transferring the circuit arrangement of the two exciter coils from a parallel connection to a series connection of the exciter coils.

For a parallel connection of the first and second exciter coils, the total resistance results as follows:

$$1/R_{ges}=/R_1+1/R_2$$

For a series connection of the first and second exciter coils, however, the total resistance results from:

$$R_{ges}=R_1+R_2$$

By switching the parallel connection of the first and second branch circuits into the series connection of the first and second exciter coils, the total resistance of the first and second exciter coil is increased. With the supply voltage unchanged, the increase in the total resistance of the serially connected first and second exciter coils in turn leads to a reduction in the coil current flowing through the first and second exciter coils. A reduced coil current in turn leads to a reduction in the magnetic flow through the first and second exciter coils and, associated therewith, to a reduction in the magnetic field of the first and second exciter coils.

Due to the low resistance of the first and second capacitors for the time segment in which the switch element is in the first switch state, the first and second branch circuits are arranged in parallel and the first and second capacitors are charged, the resistances of the first and second capacitors are negligible for the calculation the total resistance for this period.

The first and second exciter coils are preferably arranged in relation to the respective winding direction in such a way that for the second switch state of the switch element, i.e. the series connection of the first and second exciter coils, the realized magnetic flux $\Theta_{ges}$=IN of the magnetic system formed from the first and second exciter coils $\Theta$=IN of the magnetic fluxes $\Theta_{1,2}$=$IN_{1,2}$ of the first and second exciter coils results as follows:

$$\Theta_{ges}=\Theta 1+\Theta 2=IN_1+IN_2=I(N_1+N_2)$$

wherein I is the coil current and $N_{1,2}$ is the number of windings of the first and second exciter coil.

By reducing the coil current and thus reducing the coil power, the heat generated by the exciter coils is reduced.

Particularly in the case of components with a small overall size, a reduction in heat generation is advantageous due to the low heat capacity of the components.

In some examples, the first and second capacitors are configured to provide the first and second exciter coils with a charging current in the first switch state of the switch element that is suitable for causing the magnetic field of the first and second exciter coils to attract and hold the armature.

This has the technical advantage that for the time segment in which the switch element is in the first switch state and the first and second branch circuits are arranged parallel to one another, the first and second capacitors are charged by the applied operating voltage and consequently a charging current flows in the first and second branch circuits. At this stage, the first and second capacitors have low resistance and are dimensioned in such a way that a high charging current flows, and the first and second exciter coils are thus provided with a coil current that is suitable for inducing a magnetic flux and a magnetic field in the first and second exciter coils, by means of which the armature can be attracted into the contact position.

In some examples, the first and second capacitors have high resistance in the second switch state.

This has the technical advantage that for the period in which the switch element is in the first switch state and the first and second exciter coils are arranged in a parallel connection, the first and second capacitors act as high-resistance resistors and ensure that the first and second exciter coils are supplied with a coil current which is suitable for inducing a magnetic field in the first and second exciter coils which is sufficient to retain the armature in the contact position.

In some examples, the first ohmic series resistor is an ohmic resistor of a coil, which is connected upstream of the third diode and/or the plurality of third diodes connected in series.

In some examples, the switch element comprises a reed switch.

This has the technical advantage that the switch element can be addressed magnetically. The switch process of the switch element can thus be coupled directly to the attraction of the armature, in that both the switch process of the switch element and the attraction of the armature are affected by the magnetic field of the first and second exciter coils. This can also prevent a switch process of the switch element from taking place without the armature being fully attracted into the contact position beforehand.

In some examples the magnetic field of the first and second exciter coils flowing through the reed switch.

This has the technical advantage that the switch time of the switch element can be matched as precisely as possible to the time at which the armature is fully attracted into the contact position. In that the reed switch is configured to switch as soon as the magnetic field at the location of the reed switch has reached a magnetic field strength that corresponds to the magnetic field used to attract and retain the armature at the location of the armature and causes the armature to be attracted, a switch operation of the switch element is then affected when the armature has previously been fully attracted into the contact position. The reed switch is preferably arranged adjacent to the first and second exciter coils and positioned in an area in which a magnetic leakage flux of the first and second exciter coils occurs.

In some examples, the switch element comprises a reed relay.

This has the technical advantage that the switch element is configured as a robust component with high switch accuracy and switch reliability.

In some examples, the reed relay is preceded by an RC element with a time constant.

This has the technical advantage that, by means of the time constant of the RC element, the switch time of the switch element can be matched to the time at which the armature is fully attracted into the contact position. For this purpose, the RC element has a third ohmic resistor and a third capacitor. The dimensions of the third ohmic resistor and the third capacitor are matched to the first and second capacitors. The first and second capacitors are in turn dimensioned in such a way that complete charging of the first and second capacitors corresponds to a complete attraction of the armature into the contact position. A point in time at which the armature is fully attracted into the contact position can thus be determined over the duration of the charging of the first and second capacitors. By coordinating the dimensioning of the RC element with regard to the ratio of the time constant of the RC element to the duration of the charging of the first and second capacitors, coordination of the switch time of the switch element with the time of complete attraction of the armature in the contact position can be achieved. In addition, the time constant of the RC element is preferably selected such that at the time the switch element or the reed relay is switched, the voltage across the switch element has dropped to almost zero and an almost identical voltage drops across the first and second exciter coils. In this way, high current peaks which can otherwise could occur on the first and second capacitors during the switch process of the switch element can be avoided.

In some examples, the switch element comprises a transistor.

This has the technical advantage that the switch element is configured as a robust component with a high switch accuracy and switch reliability.

In some examples, the transistor is a bipolar transistor.

In some examples, the transistor is a pnp bipolar transistor.

In some examples, the transistor is an npn bipolar transistor.

This has the technical advantage that after the switch process has been completed in the series connection of the first and second exciter coils, a low excitation current flows.

In some examples, the transistor is a MOSFET transistor.

This has the technical advantage that voltage peaks at the second exciter coil are avoided. In addition, the transistor is de-energized during the switch process, so that the occurrence of power loss during the switch process on the switch element is avoided.

In some examples, a RC element and a voltage divider are connected upstream of the transistor, wherein a time constant is defined via the RC element and the voltage divider.

This has the technical advantage that the switch time of the switch element can be set via the dimensioning of the RC element and the voltage divider. For this purpose, the RC element has a third ohmic resistor and a third capacitor. The voltage divider further comprises a fourth ohmic resistor and a fifth ohmic resistor. If the dimensions of the RC element and the voltage divider with regard to the time constant are also matched in relation to the dimensioning of the first and second capacitors with regard to the duration of the charge, the switch time of the transistor can be matched to the time at which the armature is fully attracted into the contact position. The RC element is connected to the base connection of the transistor via the voltage divider, so that the time constant of the RC element and the voltage divider can be used to regulate the time at which the transistor is switched to a conductive state and thus switches. The time constant of the RC element and the voltage divider is preferably selected such that current peaks of the collector-emitter current of the transistor, which can occur when switching off, and the steepness of the current when switching on and off can be achieved. Furthermore, by choosing the resistance ratio of the resistors of the RC element and the voltage divider, current peaks, and voltage slopes of the collector-emitter current of the transistor can be reduced.

In some examples, the first branch circuit further comprises a first diode and the second branch circuit further comprises a second diode, wherein the first diode is arranged on the first branch circuit between the first exciter coil and the first capacitor, and wherein the second diode is arranged on the second branch circuit between the second capacitor and the second exciter coil.

This has the technical advantage that the current directions are fixed on the first and second branch circuits. This is particularly advantageous for the switch process of the transistor in order to prevent undesired backward currents which can occur during the switch process and which run counter to the intended current direction of the series connection of the first and second exciter coils.

In some examples, the switch element comprises a diode.

The switch element is configured here as a diode, in particular as a third diode, which is operated in the flow direction when the two coils are connected in series. The switchover from parallel to series connection can take place by the voltage difference between the first branch circuit and the second branch circuit. This is at least equal to the breakdown voltage of the diode, which means that a voltage below the breakdown voltage corresponds to a first switch state and a voltage equal to or higher than the breakdown voltage corresponds to the second switch state. In addition, several diodes can be arranged in series and/or a series resistor to the diode between the first branch circuit and the second branch circuit in order to vary the switch time. Due to the additional voltage drop across the diode and the resistor, the current in series connection of the coils can be further reduced. The heat losses can be reduced.

In some examples, the switch element comprises a third diode and a first ohmic series resistor connected in series with the third diode.

This has the technical advantage that the switch element can be easily manufactured and the switch process takes place automatically. The switch process of the switch element, which converts the parallel connection of the first and second branch circuits into the series connection of the first and second exciter coils, begins as soon as the voltage difference between the first and second branch circuits corresponds to at least the breakdown voltage of the third diode. In addition, the additional voltage drop across the third diode and the first ohmic series resistor of the switch element in the branch circuit between the first and second branch circuits can further reduce the current in the series connection of the first and second exciter coils, so that the heat losses through the first and second exciter coils can be also reduced.

In some examples, the switch element comprises a plurality of third diodes connected in series and a first ohmic series resistor connected in series.

This achieves the technical advantage that the switch time of the switch element can be varied through the plurality of third diodes and the first ohmic series resistor, which is adapted to the resistance value of the plurality of third diodes.

In some examples, the switch element comprises a transistor and a Hall sensor.

This has the technical advantage that the switch element is configured as a robust component with high switch accuracy and switch reliability. Furthermore, the technical advantage is achieved that, via the Hall sensor, the switch process of the transistor is coupled to the magnetic field of the first and second exciter coils which causes the armature to be attracted into the contact position.

In some examples, the Hall sensor is electrically connected to the transistor and the magnetic field of the first and second exciter coils flows through it.

This has the technical advantage that the switch behavior of the transistor can be coupled to the magnetic field of the first and second exciter coils via the Hall sensor. In this way, it can be avoided that a switch process of the switch element takes place without prior complete attraction of the armature into the contact position. The Hall sensor is preferably arranged adjacent to the first and second exciter coils and positioned in an area in which a magnetic leakage flux of the first and second exciter coils occurs.

In some examples, a voltage divider is arranged between the Hall sensor and the base connection of the transistor.

This has the technical advantage that the magnetic field of the first and second exciter coils flowing through the Hall sensor causes a Hall voltage corresponding to the magnetic field, which in turn is applied to the base terminal of the transistor. If the magnetic field of the first and second exciter coils reaches a corresponding limit value, the transistor is switched to the conductive state by the corresponding Hall voltage applied to the base terminal of the transistor. By appropriately configuring the sensor or by appropriately adapting the voltage applied to the base terminal by appropriately dimensioning the voltage divider, it can be achieved that the transistor is placed in the conductive state for a value of the magnetic field of the first and second exciter coils that is sufficient for completely attracting in the armature to the contact position.

In some examples, the Hall sensor is arranged in parallel with a Zener diode.

This has the technical advantage that the applied voltage is limited to the nominal supply voltage of the Hall sensor via the parallel-connected Zener diode.

In some examples, the electromagnetic relay further comprises a first connection contact, a second connection contact, a third connection contact and a fourth connection contact, which serve to apply a supply voltage to the first and second exciter coils, wherein the first connection contact is electrically connected to the start of the winding of the first exciter coil, wherein the second connection contact is connected to the winding end of the first exciter coil, wherein the third connection contact is connected to the winding start of the second exciter coil, and wherein the fourth connection contact is connected to the winding end of the second exciter coil.

This has the technical advantage that the relay can be configured as a relay with a narrow design, (e.g., a narrow overall width), and can be used for a series terminal (e.g., a 6.2 mm series terminal or 3.5 mm series terminal). Furthermore, the technical advantage is achieved that the first and second exciter coils can be arranged in a parallel connection.

In some examples, the reed switch is electrically connected to the second and third connection contacts.

This achieves the technical advantage of a construction of the relay that is as space-saving as possible, in that the switch element is formed directly on the relay. Furthermore, the technical advantage is achieved that the reed switch is arranged spatially as close as possible to the coils, thus ensuring that the reed switch is optimally flooded with the magnetic field of the first and second exciter coils. This increases the switch accuracy of the switch element and enables switching at precisely the point in time at which the armature is fully attracted into the contact position.

In some examples, the electromagnetic relay further comprises a circuit board which is arranged adjacent to the first and second exciter coils and is electrically connected to the first, second, third and fourth connection contacts.

This in turn achieves the technical advantage of a construction of the relay that is as space-saving as possible, in that the electronic components used for the switch element can be formed directly on the relay in a space-saving manner.

In some examples, the switch element is formed on the printed circuit board, is electrically connected to the second and third connection contacts and is arranged adjacent to the first and second exciter coils.

This in turn achieves the technical advantage of a relay that is as space-saving as possible. Furthermore, the technical advantage is achieved that the parallel connection of the first and second exciter coils can be switched into a series connection of the first and second exciter coils via the switch element.

In some examples, the reed relay is formed on the printed circuit board, is electrically connected to the second and third connection contacts and is arranged adjacent to the first and second exciter coils.

This in turn achieves the technical advantage of a relay that is as space-saving as possible. Furthermore, the technical advantage is achieved that the parallel connection of the first and second exciter coils can be switched into a series connection of the first and second exciter coils via the reed relay.

In some examples, the transistor is formed on the printed circuit board, the emitter connection of the transistor being electrically connected to the second connection contact and the collector connection of the transistor being electrically connected to the third connection contact.

This in turn achieves the technical advantage of a relay that is as space-saving as possible. Furthermore, the technical advantage is achieved that the parallel connection of the first and second exciter coils be connected in a series connection of the first and second exciter coils via the transistor.

In some examples, the Hall sensor is formed on the circuit board and is arranged adjacent to the first and second exciter coils.

This in turn achieves the technical advantage of a relay that is as space-saving as possible. Furthermore, the technical advantage is achieved that the Hall sensor is arranged spatially as close as possible to the coils, thus ensuring that the Hall sensor is optimally flooded by the magnetic field of the first and second exciter coils. This increases the switch accuracy of the switch element and enables switching at precisely the point in time at which the armature is fully attracted into the contact position.

In some examples, the yoke is configured as a U-shaped yoke with two parallel legs arranged opposite one another.

This in turn achieves the technical advantage of a relay that is as space-saving as possible. Furthermore, the technical advantage is achieved that the yoke can accommodate two exciter coils.

In some examples, the armature is configured to be swivellably at one end of one of the legs of the U-shaped yoke.

In some examples, the first and second exciter coils are each arranged on the legs of the yoke.

This achieves the technical advantage that the present relay can be configured to be as space-saving as possible, in that the windings used for attracting and retaining the armature can be divided between two spatially separated coils.

BRIEF DESCRIPTION OF THE DRAWINGS

Further exemplary implementations of the principles described herein are explained with reference to the accompanying figures.

DETAILED DESCRIPTION

Figure 1:
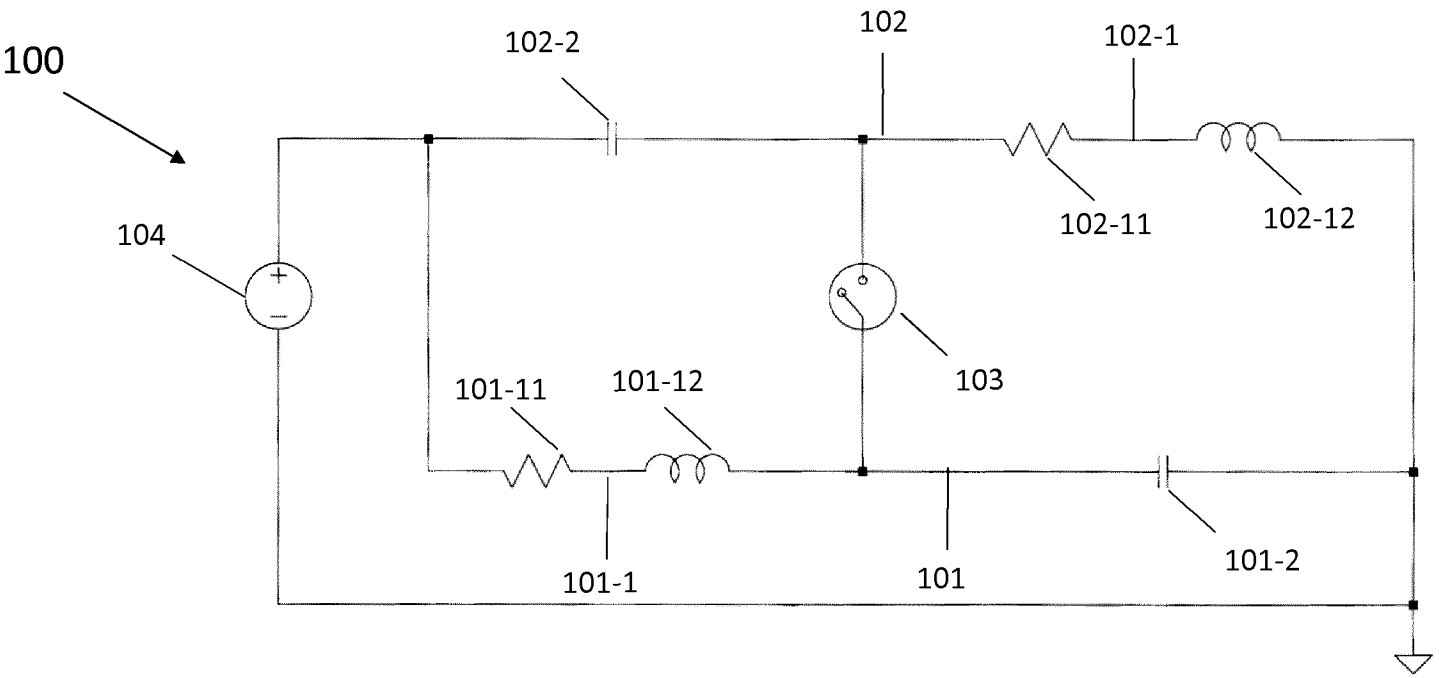
FIG. 1 shows an equivalent circuit diagram of the relay according to an example of the present disclosure.

FIG. 1 shows an equivalent circuit diagram of the relay 100 according to an example of the present disclosure. The electromagnetic relay 100 comprises a yoke 601 and an armature 602 arranged swivellably on the yoke 601 (both not shown in FIG. 1), the armature 602 having an open position and a contact position relative to the yoke 601, and the armature 602 being formed to be attracted by a magnetic field from the open position to the contact position and retained in the contact position.

According to FIG. 1, the electromagnetic relay 100 further comprises a first branch circuit 101, which has a first capacitor 101-2 and a first exciter coil 101-1 connected in series thereto, a second branch circuit 102, which has a second capacitor 102-2 and a second exciter coil 102-1 connected in series with the same, wherein the first exciter coil 101-1 and the second exciter coil 102-1 are configured to provide the magnetic field for attracting and retaining the armature 602, and a switch element 103, which is arranged between the first branch circuit 101 and the second branch circuit 102 and has a first switch state and a second switch state, wherein in the first switch state of the switch element 103 the first branch circuit 101 and the second branch circuit 102 are arranged in a parallel connection, and wherein in the second switch state of the switch element 103 the first exciter coil 101-1 and the second exciter coil 102-1 are arranged in a series connection, and wherein the switch element 103 is configured to switch from the first switch state to the second switch state when the armature 602 is attracted to the contact position by the magnetic field of the first and second coils.

According to FIG. 1, the 1. exciter coil 101-1 has a first ohmic resistor 101-11 and a first inductance 101-12, while the second exciter coil 102-1 has a second ohmic resistor 2-11 and a second inductance 102-12.

The switch element 103 is arranged between the first branch circuit 101 and the second branch circuit 102 in such that the switch element 103 is arranged between the first exciter coil 101-1 and the first capacitor 101-2 and the second capacitor 102-2 and the second exciter coil 102-1.

In a first switch state of the switch element 103, which is preferably an open switch state of the switch element 103, in which the switch element 103 has a high resistance, the first branch circuit 101 and the second branch circuit 102 are arranged parallel to one another.

The application of a supply voltage by the voltage source 104 causes the first capacitor 101-2 and the second capacitor 102-2 to be charged. While the first and second capacitors 101-2, 102-2 are being charged, corresponding charging currents flow through the first and second exciter coils 101-1, 101-2 of the first and second branch circuits 101, 102. The first and second capacitors 101-2, 102-2 are dimensioned such that the charging currents flowing through the first and second exciter coils 101-1, 102-1 are suitable for causing a magnetic flow through the first and second exciter coils 101-1, 102-1 and effecting a corresponding magnetic field that is suitable to fully attract the armature 602 of the relay 100 to the contact position. The first and second capacitors 101-2, 102-2 are also dimensioned such that at the time when the armature 602 is fully attracted into the contact position, the first and second capacitors 101-2, 102-2 are fully charged and therefore have a high resistance.

When the switch element 103 is switched to the second switch state, which is preferably a closed state of the switch element 103 in which the switch element 103 has a low-resistance, the parallel connection of the first and second branch circuits 101, 102 is switched into a series connection of the second and second exciter coils 101-1, 102-1.

The first and second capacitors 101-2, 102-2, which are high-resistance at the time of switching of the switch element 103 and are not part of the series connection of the first and second exciter coils 101-1, 102-1, ensure that a primary current path runs along the series connection of the first and second exciter coils 101-1, 102-1.

When the parallel connection of the first and second branch circuits 101, 102 is switched over to the series connection of the first and second exciter coils 101-1, 102-1, the total resistance of the first and second exciter coils 101-1, 102-1 is increased. This results in a reduction in the coil currents, with the external applied voltage remaining the same, and an associated reduction in the magnetic flow and the magnetic field of the first and second exciter coils 101-1, 102-1, whereby the power loss can be reduced.

The switch process of the switch element 103 from the first switch state to the second switch state takes place after the armature 602 is fully attracted to the contact position.

Figure 1A:
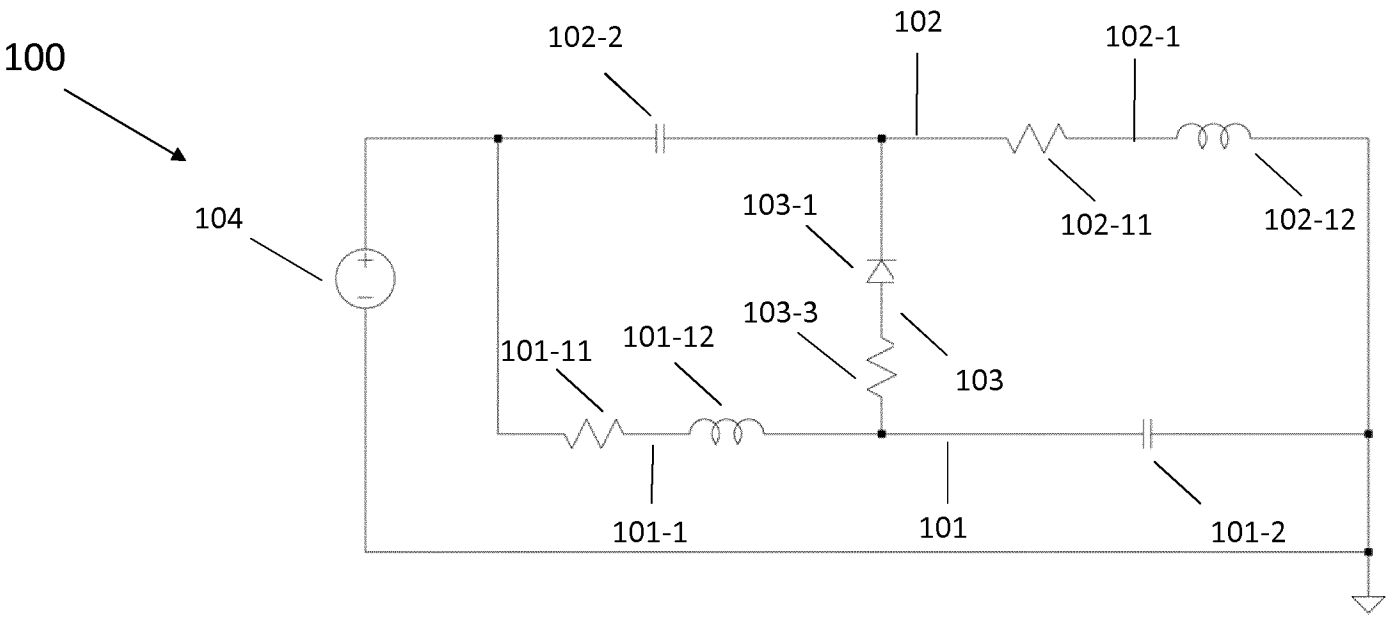
FIG. 1A shows an equivalent circuit diagram of the relay according to a further example of the present disclosure.

FIG. 1A shows an equivalent circuit diagram of the relay 100 according to a further example. In some examples, the switch element 103 comprises a third diode 103-1 and a first ohmic series resistor 103-3 connected in series upstream of the third diode 103-1. By means of the third diode 103-1 and the first ohmic series resistor 103-3, which is connected serially upstream, the time of the switch process of the switch element 103 at which the parallel connection of the first and second branch circuits 101, 102 is transferred into the series connection of the first and second exciter coils 101-1, 102-1, can be coupled to the voltage difference between the first and second branch circuits 101, 102. The switch element 103 accordingly switches as soon as the voltage difference between the first and second branch circuits 101, 102 corresponds to the breakdown voltage of the third diode 103-1.

In some examples (not shown in FIG. 1A), the switch element 103 comprises a plurality of third diodes 103-1 connected in series and a plurality of first ohmic series resistors 103-3 connected in series. In this way, the point in time of the switch process of the switch element 103 can be made variable.

In some examples (not shown in FIG. 1A), the first ohmic series resistor 103-3 is an ohmic resistor of a coil, which is connected upstream of the third diode 103-1 and/or the plurality of third diodes 103-1 connected in series.

Figure 2:
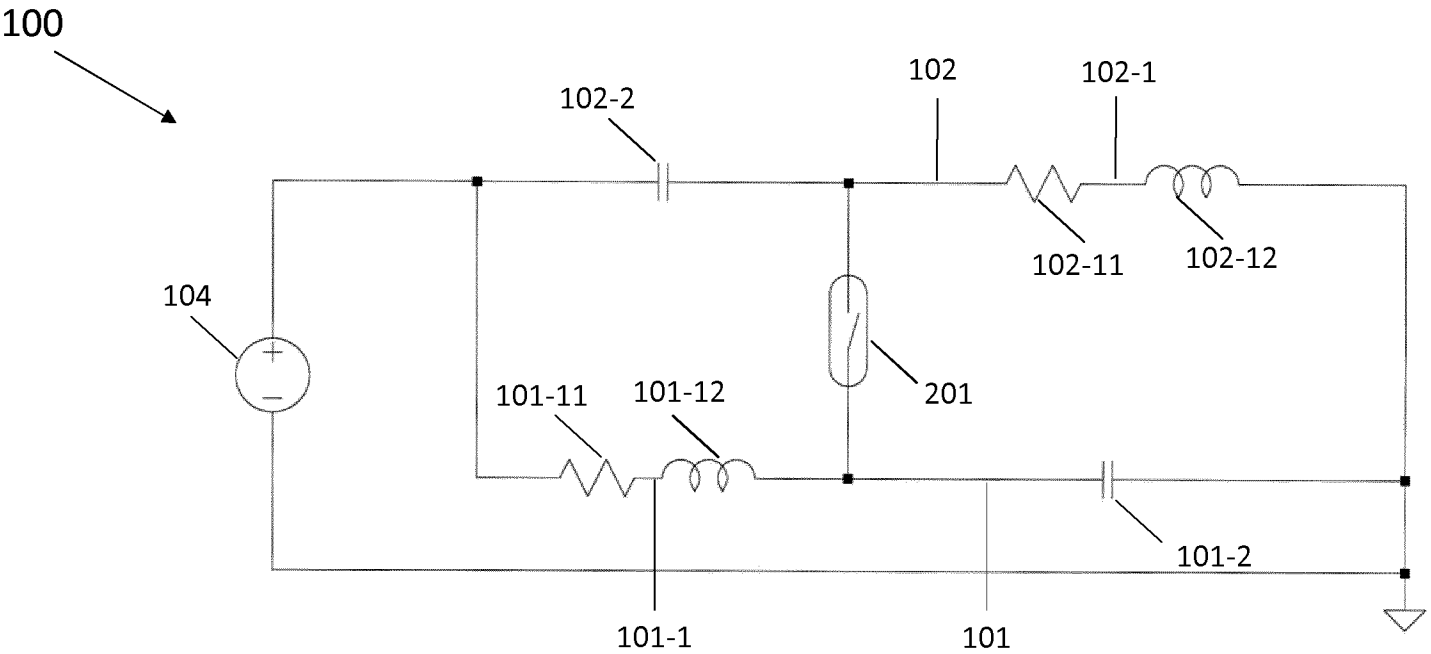
FIG. 2 shows an equivalent circuit diagram of the relay according to a further example of the present disclosure.

FIG. 2 shows an equivalent circuit diagram of the relay 100 according to a further example of the present disclosure. In some examples, the switch element 103 comprises a reed switch 201. By means of the reed switch 201, the switch process of the switch element 103 can be triggered via the magnetic field of the first and second exciter coils by the reed switch 201 switching as soon as the magnetic field of the first and second exciter coils 101-1, 102-1 exceeds a predetermined limit value corresponding to a magnetic field that is sufficient to fully attract the armature 602 into the contact position.

Figure 3:
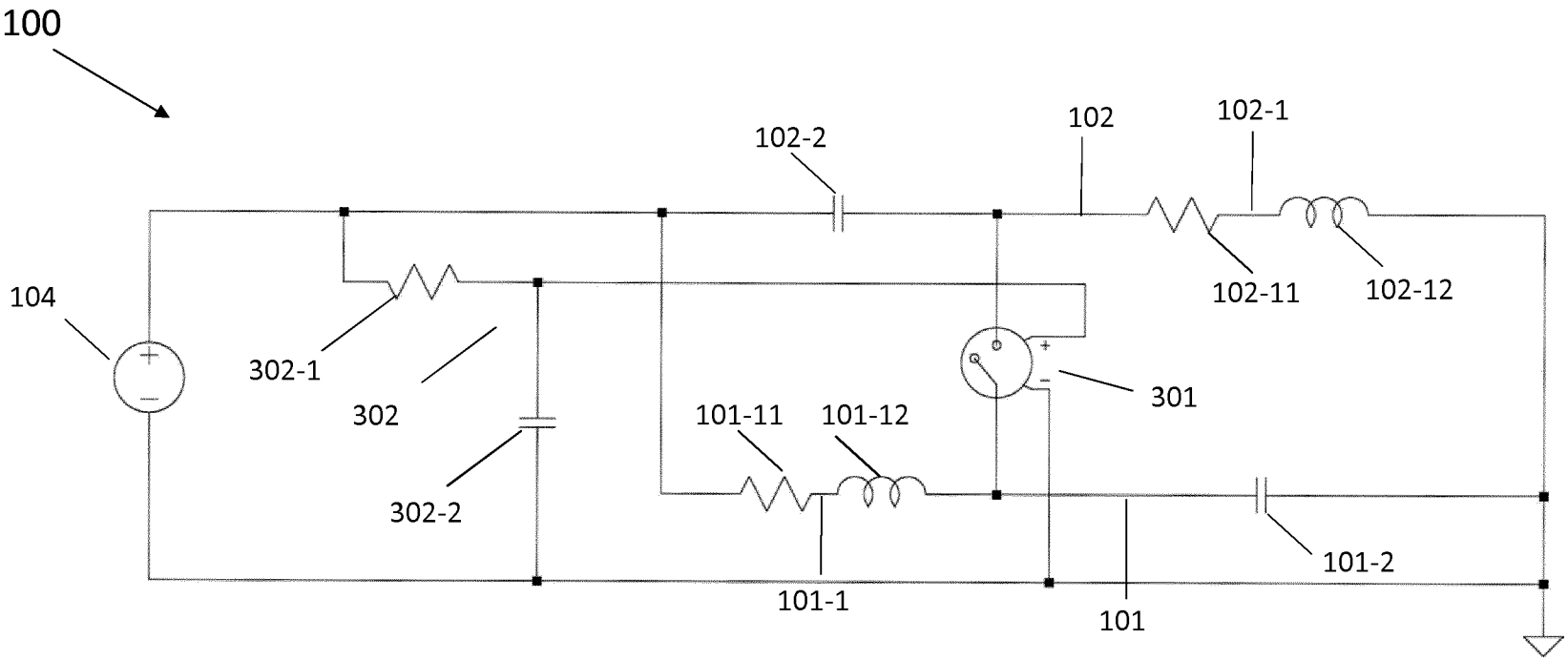
FIG. 3 shows an equivalent circuit diagram of the relay according to a further example of the present disclosure.

FIG. 3 shows an equivalent circuit diagram of relay 100 according to a further example of the present disclosure. In some examples, the switch element 103 comprises a reed relay 301. The reed relay 301 is also connected to an RC element 302, which comprises a third ohmic resistor 302-1 and a third capacitor 302-2. The switch time of the reed relay 301 can be set by coordinating the time constant of the RC element 302, so that the time constant of the RC element 302 is coordinated with the period of charging of the first and second capacitors 101-2, 102-2, so that the switch process of the reed relay 301 takes place exactly after the armature 602 has been fully attracted into the contact position.

Figure 4:
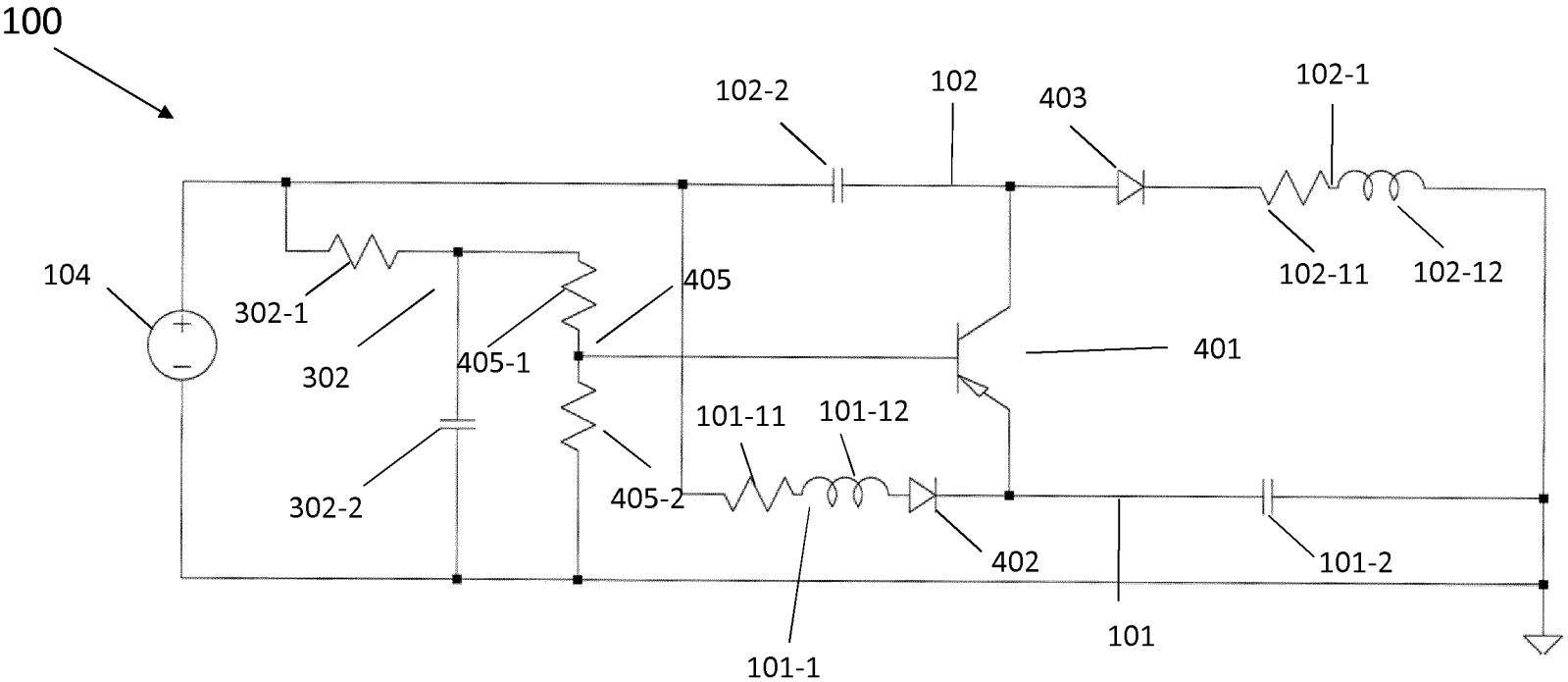
FIG. 4 shows an equivalent circuit diagram of the relay according to a further example of the present disclosure.

FIG. 4 shows an equivalent circuit diagram of the relay 100 according to a further example of the present disclosure. In some examples, the switch element 103 comprises a transistor 401. The transistor 401 is connected via the base connection to a voltage divider 405, which comprises a fourth ohmic resistor 405-1 and a fifth ohmic resistor 405-2, and an RC element 302, which comprises one third ohmic resistor 302-1 and a third capacitor 302-2. Via the dimensioning of the RC element 302 and the fourth and fifth ohmic resistors 405-1, 405-2 of the voltage divider 405, the switch time of the transistor 401 can be matched to the time when the armature 602 is fully attracted into the contact position.

According to FIG. 4, the first branch circuit 101 furthermore has a first diode 402 and the second branch circuit 102 has a second diode 403. The first and second diodes 402, 403 are arranged between the first exciter coil 101-1 and the first capacitor 101-2 and the second capacitor 102-2 and the second exciter coil 102-1, in that the first and second diodes 402, 403 are parts of the series connection of the first and second exciter coils 101-1, 102-1, when the transistor 401 is in the conductive state and the switch element 103 is thus in the second switch state.

Figure 5:
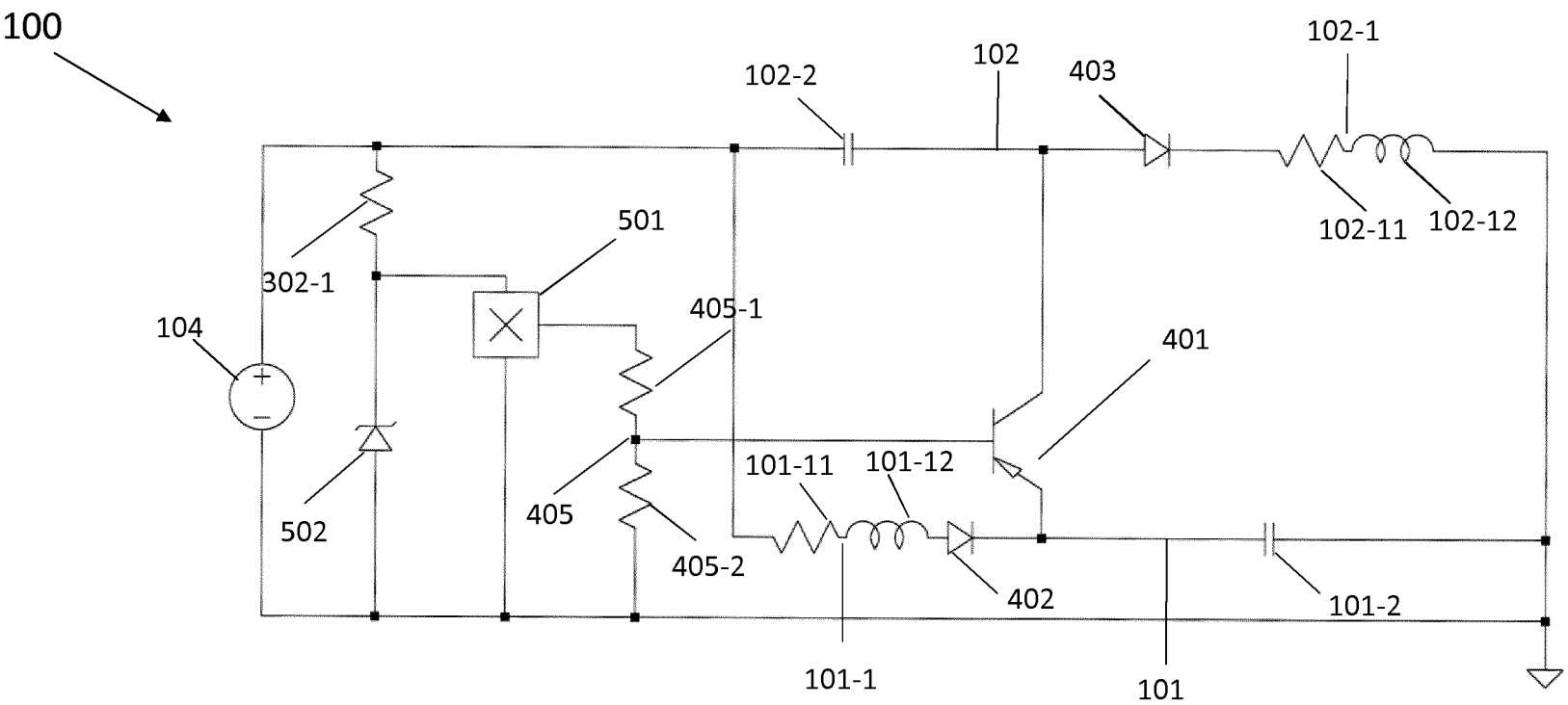
FIG. 5 shows an equivalent circuit diagram of the relay according to a further example of the present disclosure.

FIG. 5 shows an equivalent circuit diagram of relay 100 according to a further example of the present disclosure. In some examples, the switch element 103 comprises a transistor 401 and a Hall sensor 501. The Hall sensor 501 is connected to the base terminal of the transistor 401 via the voltage divider 405 and enables the switch process of the transistor 401 to be coupled with the magnetic field of the first and second exciter coils 101-1, 102-1. If the magnetic field of the first and second exciter coils 101-1, 102-1 exceeds a predetermined limit value, the Hall voltage of the Hall sensor 501 applied to the base connection of the transistor 401 causes the transistor 401 to switch from a non-conductive to a conductive state and thus the switch process of the switch element 103 from the first switch state to the second switch state. It is thus achieved that the switch process of the transistor 401 takes place exactly after the armature 601 has been fully attracted into the contact position. To limit the supply voltage of the voltage source 104 to the nominal supply voltage of the Hall sensor 501, a Zener diode 502 is also connected in parallel with it.

Figure 6:
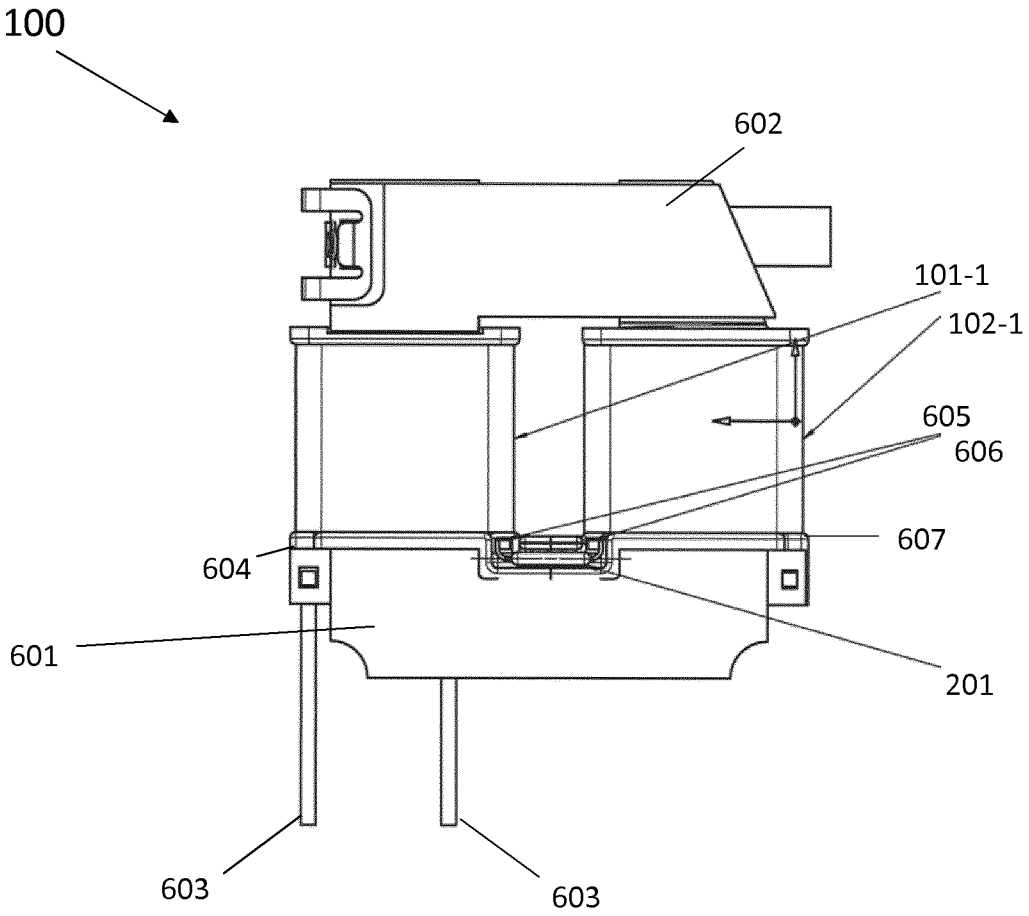
FIG. 6 is a schematic front view of the relay according to an example of the present disclosure.

FIG. 6 shows a schematic front view of the relay 100 according to an example of the present disclosure. In some examples, the relay 100 comprises a yoke 601 and an armature 602 swivellably mounted on the yoke 601. In some examples, the yoke 601 is configured as a U-shaped yoke with two opposing parallel legs, wherein the armature 602 is configured to be swivellable at the end of one of the legs (not shown in FIG. 6) and is in the contact position when the armature 602 contacts the end of the respective other leg of the yoke 601. In some examples, the first and second exciter coils 101-1, 102-1 are each arranged on the two legs of the yoke 601 which are arranged parallel opposite one another.

In some examples, the relay 100 comprises a first connection contact 604, a second connection contact 605, a third connection contact 606 and a fourth connection contact 607. Furthermore, In some examples, the first connection contact 604 is connected to the winding start of the first exciter coil 101-1 and the second connection contact 605 is connected to the winding end of the first exciter coil 101-1, while the third connection contact 606 is connected to the winding start of the second exciter coil 102-1 and the fourth connection contact 607 is connected to the winding end of the second exciter coil 102-1. Furthermore, the relay 100 has two connection pins 603 which are suitable for effecting a connection of the relay 100 with a corresponding series terminal.

In some examples, the reed switch 201 is arranged between the first and second exciter coils 101-1, 102-1 and is connected to the third and fourth connection contacts 606, 607. In some examples, the reed switch 201 is arranged adjacent to the first and second exciter coils 101-1, 102-1 and is positioned in an area in which a magnetic leakage flux of the first and second exciter coils 101-1, 102-1 occurs.

Figures 7A, 7B:
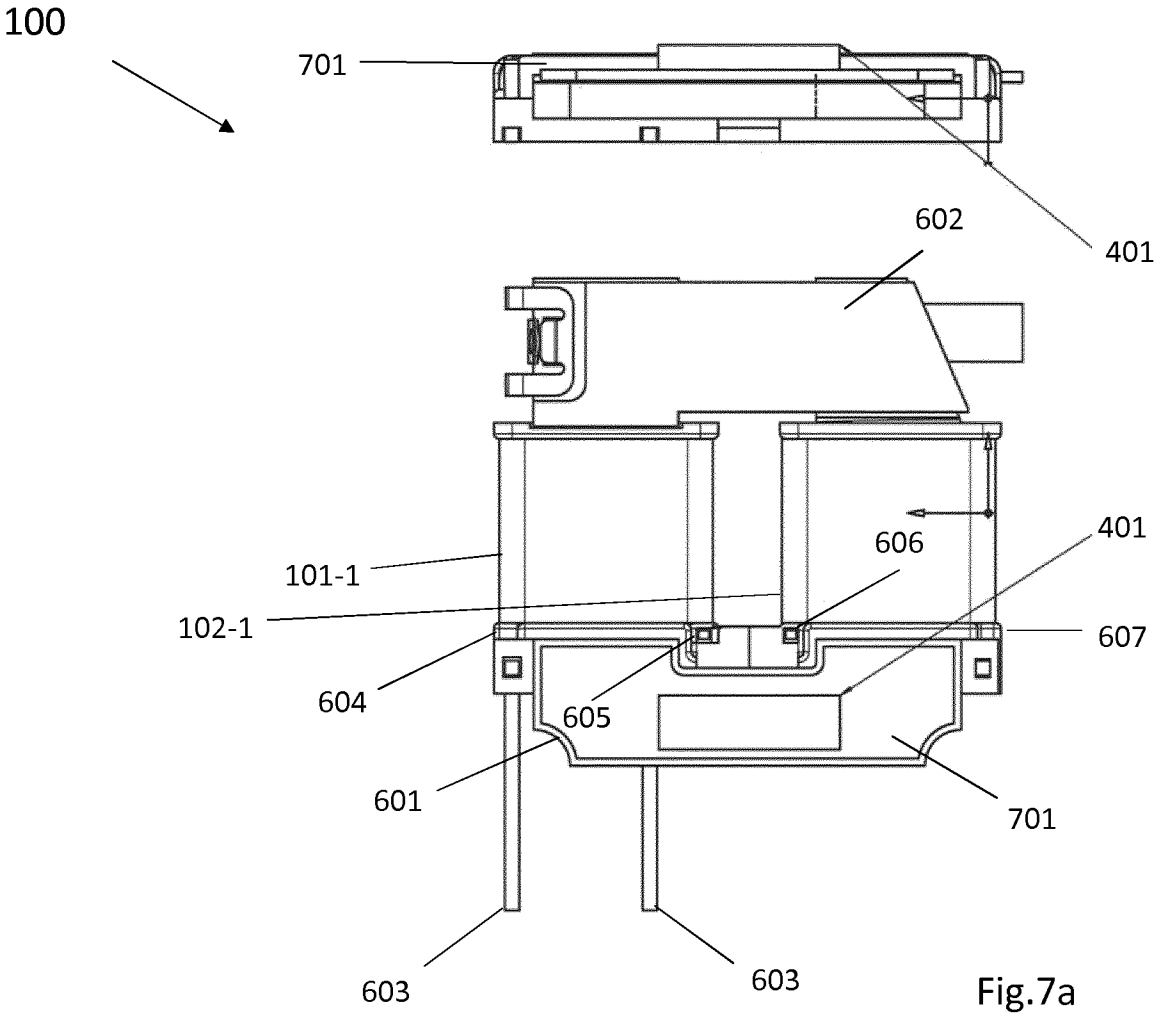
FIG. 7*a* shows a schematic front view of the relay according to a further example of the present disclosure.
FIG. 7*b* is a schematic bottom view of the relay in FIG. 7*a;*

FIGS. 7*a* and 7*b* show schematic views of different perspectives of the relay 100 according to a further example of the present disclosure. In some examples, a printed circuit board 701 is formed in the front region of the connecting section of the two legs of the yoke 601. The circuit board 701 is electrically connected to the first, second, third and fourth connection contacts 604, 605, 606, 607 and is used to hold the switch element 103 and other electronic components. In some examples, the reed relay 301 is formed on the circuit board 701.

Figures 8A, 8B:
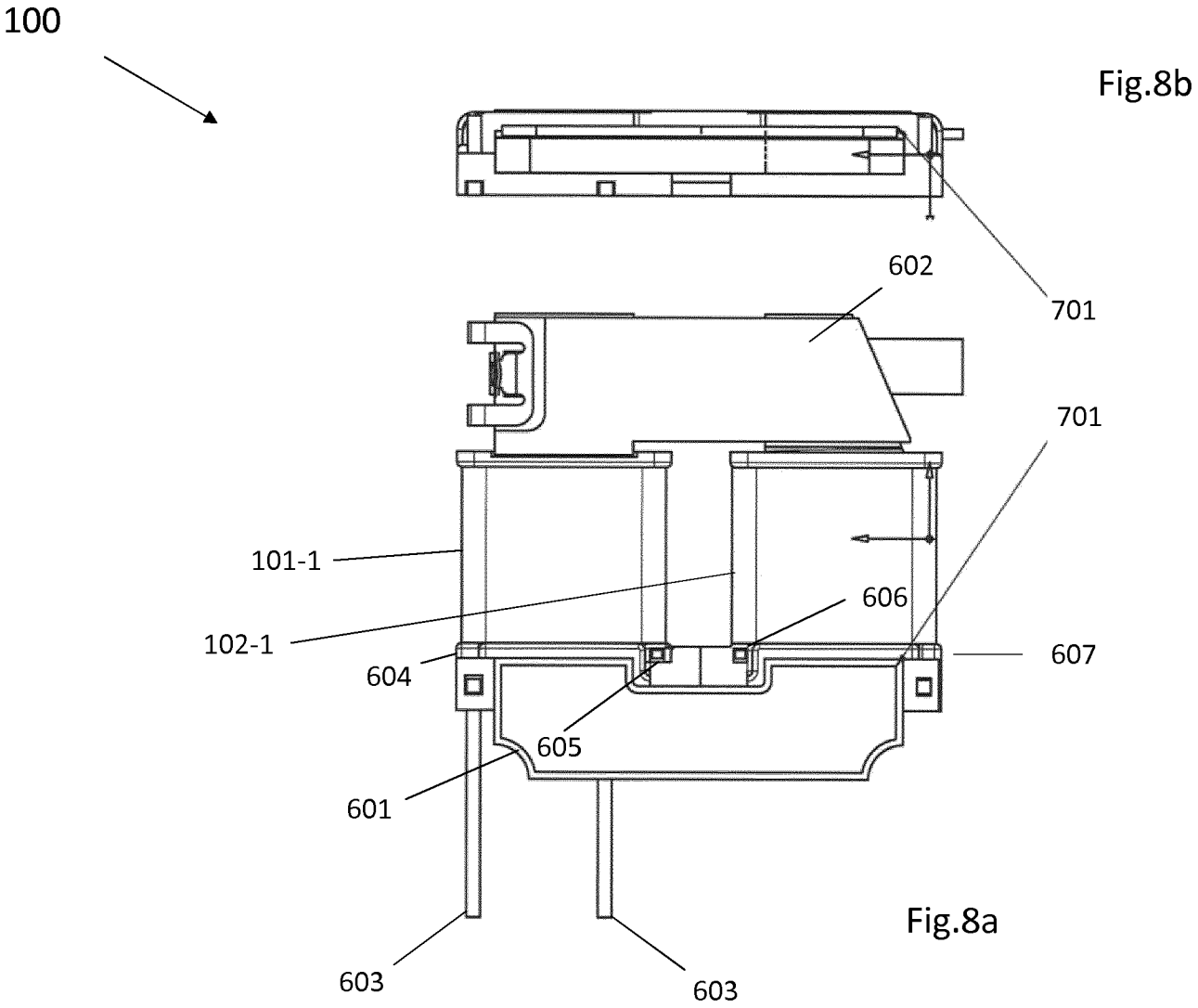
FIG. 8*a* shows a schematic front view of the relay according to a further example of the present disclosure.
FIG. 8*b* is a schematic bottom view of the relay in FIG. 8*a*.

FIGS. 8*a* and 8*b* show schematic views of different perspectives of the relay 100 according to a further example of the present disclosure. In some examples, the transistor 401 is formed on the circuit board 701.

Figure 9:
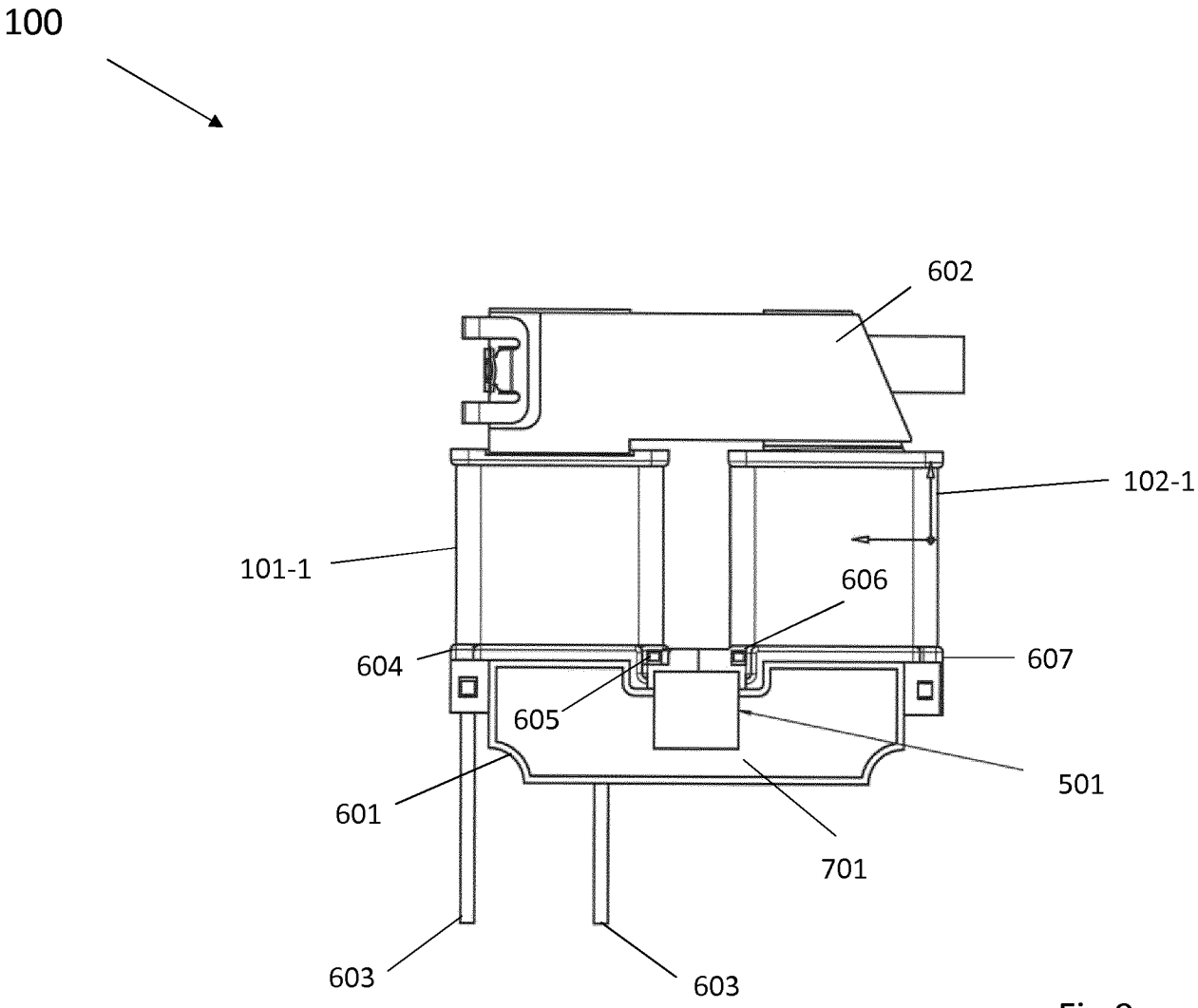
FIG. 9 is a schematic front view of the relay according to a further example of the present disclosure.

FIG. 9 shows a further schematic view of the relay 100 according to a further example of the present disclosure. In some examples, the Hall sensor 501 is formed on the circuit board 701.

LIST OF REFERENCE NUMBERS

100 relay
101 first branch circuit
101-1 first exciter coil
101-11 first ohmic resistance
101-12 first inductance
101-2 first capacitor
102 second branch circuit
102-1 second exciter coil
102-11 second ohmic resistor
102-12 second inductor
102-2 second capacitor
103 switch element
103-1 third diode
103-3 first ohmic series resistor
104 voltage source
201 reed switch
301 reed relay
302 RC element
302-1 third ohmic resistor
302-2 third capacitor
401 transistor
402 first diode
403 second diode
405 voltage divider
405-1 fourth ohmic resistor
405-2 fifth ohmic resistor
501 Hall sensor
502 Zener diode
601 yoke
602 anchor
603 connector pin
604 first connection contact
605 second connection contact
606 third connection contact
607 fourth connection contact
701 circuit board

What is claimed is:

1. An electromagnetic relay, comprising:

a yoke; and an armature that is swivellably arranged on the yoke, has an open position and a contact position in relation to the yoke, and is designed to be attracted by a magnetic field out of the open position into the contact position and retained in the contact position, the armature comprising:

a first branch circuit having a first capacitor and a first exciter coil connected in series with the first capacitor, a second branch circuit having a second capacitor and a second exciter coil connected in series with the second capacitor, wherein the first exciter coil and the second exciter coil are configured to provide the magnetic field for attracting and retaining the armature; and a switch element arranged between the first branch circuit and the second branch circuit and having a first switch state and a second switch state, wherein the first branch circuit and the second branch circuit are arranged in a parallel connection in the first switch state of the switch element, and wherein the first exciter coil and the second exciter coil are arranged in a series connection in the second switch state of the switch element, and wherein the switch element is configured to switch from the first switch state to the second switch state when the armature is attracted into the contact position by the magnetic field of the first exciter coil and the second exciter coil.

2. The electromagnetic relay of claim 1, wherein the first capacitor and the second capacitor are configured to provide the first exciter coil and the second exciter coil with a charging current in the first switch state of the switch element that causes the magnetic field of the first exciter coil and the second exciter coil to attract and hold the armature.

3. The electromagnetic relay of claim 1, wherein the first capacitor and the second capacitor have a resistance that exceeds a threshold in the second switch state.

4. The electromagnetic relay of claim 1, wherein the switch element comprises a reed switch.

5. The electromagnetic relay of claim 4, wherein the magnetic field of the first exciter coil and the second exciter coil is configured to flow through the reed switch.

6. The electromagnetic relay of claim 1, wherein the switch element comprises a reed relay.

7. The electromagnetic relay of claim 6, wherein the reed relay is downstream of an RC element with a time constant.

8. The electromagnetic relay of claim 1, wherein the switch element comprises a diode.

9. The electromagnetic relay of claim 1, wherein the switch element comprises a transistor.

10. The electromagnetic relay of claim 9, wherein a RC element and a voltage divider are connected upstream of the transistor, wherein a time constant is based at least in part on the RC element and the voltage divider.

11. The electromagnetic relay of claim 1, wherein the switch element comprises a transistor and a Hall sensor.

12. The electromagnetic relay of claim 11, wherein the Hall sensor is electrically connected to the transistor and the magnetic field of the first exciter coil and the second exciter coil flows through the Hall sensor.

13. The electromagnetic relay of claim 1, further comprising:

a first connection contact;

a second connection contact;

a third connection contact;

a fourth connection contact, the first connection contact, the second connection contact, the third connection contact, and the fourth connection contact configured to apply a supply voltage to the first exciter coil and the second exciter coil, wherein the first connection contact is electrically connected to a winding start of the first exciter coil, wherein the second connection contact is connected to a winding end of the first exciter coil, wherein the third connection contact is electrically connected to the winding start of the second exciter coil, and wherein the fourth connection contact is connected to the winding end of the second exciter coil.

14. The electromagnetic relay of claim 13, further comprising:

a circuit board arranged adjacent to the first exciter coil and the second exciter coil and electrically connected to the first connection contact, the second connection contact, the third connection contact, and the fourth connection contact.

15. The electromagnetic relay of claim 14, wherein the switch element is formed on the circuit board is electrically connected to the second connection contact and the third connection contact, and is arranged adjacent to the first exciter coil and the second exciter coil.

16. A method for operating a relay, comprising:

connecting a first branch circuit of the relay and a second branch circuit of the relay in parallel;

applying, based at least in part on first branch circuit and the second branch circuit being connected in parallel, a supply voltage to the first branch circuit and the second branch circuit, wherein:

a first capacitor of the first branch circuit and a second capacitor of the second branch circuit are charged based at least in part on the applying, a first current of the first capacitor flows through a first exciter coil of the first branch circuit and a second current of the second capacitor flows through a second exciter coil of the second branch circuit based at least in part on the first capacitor and the second capacitor being charged, and a magnetic field attracts an armature of the relay into a contact position based at least in part on the first current flowing through the first exciter coil and the second current flowing through exciter coil; and connecting, based at least in part on the armature being in the contact position, the first exciter coil and the second exciter coil in series, wherein a third current flows through the first exciter coil and the second exciter coil, the third current being reduced relative to the first current and the second current, and wherein the armature is retained in the contact position based at least in part on the third current.

17. The method for claim 16, wherein a resistance of the first capacitor and a resistance the second capacitor exceed a threshold based at least in part on the armature being in the contact position.

18. The method for claim 16, wherein the first capacitor and the second are fully charged based at least in part on the armature being in the contact position.

19. The method for claim 16, wherein applying the supply voltage to the first branch circuit and the second branch circuit comprises:

applying the supply voltage to the first exciter coil and the second exciter coil.

20. The method for claim 16, wherein the first current of the first capacitor comprises a first charging current for the first capacitor and the second current of the second capacitor comprises a second charging current for the second capacitor.

* * * * *